United States Patent [19]

Yuhas

[11] 4,098,220

[45] Jul. 4, 1978

[54] ALARM

[76] Inventor: Edward Richard Yuhas, 40 Cambridge Ave., Yonkers, N.Y. 10701

[21] Appl. No.: 720,435

[22] Filed: Sep. 3, 1976

[51] Int. Cl.[2] ..... G08B 17/04

[52] U.S. Cl. ..... 116/106; 116/103; 222/39

[58] Field of Search ..... 116/106, 103, 114.5, 116/137 R; 169/23, 26; 222/39, 396

[56] References Cited

U.S. PATENT DOCUMENTS

| | | | |
|---|---|---|---|
| 337,098 | 3/1886 | Volke | 116/137 R |
| 992,487 | 5/1911 | Ellison | 116/137 R |
| 2,410,310 | 10/1946 | Smith | 116/103 |
| 2,777,416 | 1/1957 | Messick | 116/106 |
| 3,192,890 | 7/1965 | Smith | 116/114.5 |
| 3,520,368 | 7/1970 | Hayes | 116/106 X |
| 3,667,419 | 6/1972 | Sullivan | 116/106 |
| 3,961,597 | 6/1976 | Lester et al. | 116/103 |

*Primary Examiner*—Daniel M. Yasich

*Attorney, Agent, or Firm*—Toren, McGeady and Stanger

[57] ABSTRACT

A pressurized container fitted with a fusible plug and containing a suitable propellent with a vapor operated sounding alarm attached is constructed as a selfcontained sounding device that produces its sound when subjected to heat sufficient to cause the fusible plug to melt permitting the propellent to escape through the alarm attached to the container.

5 Claims, 1 Drawing Figure

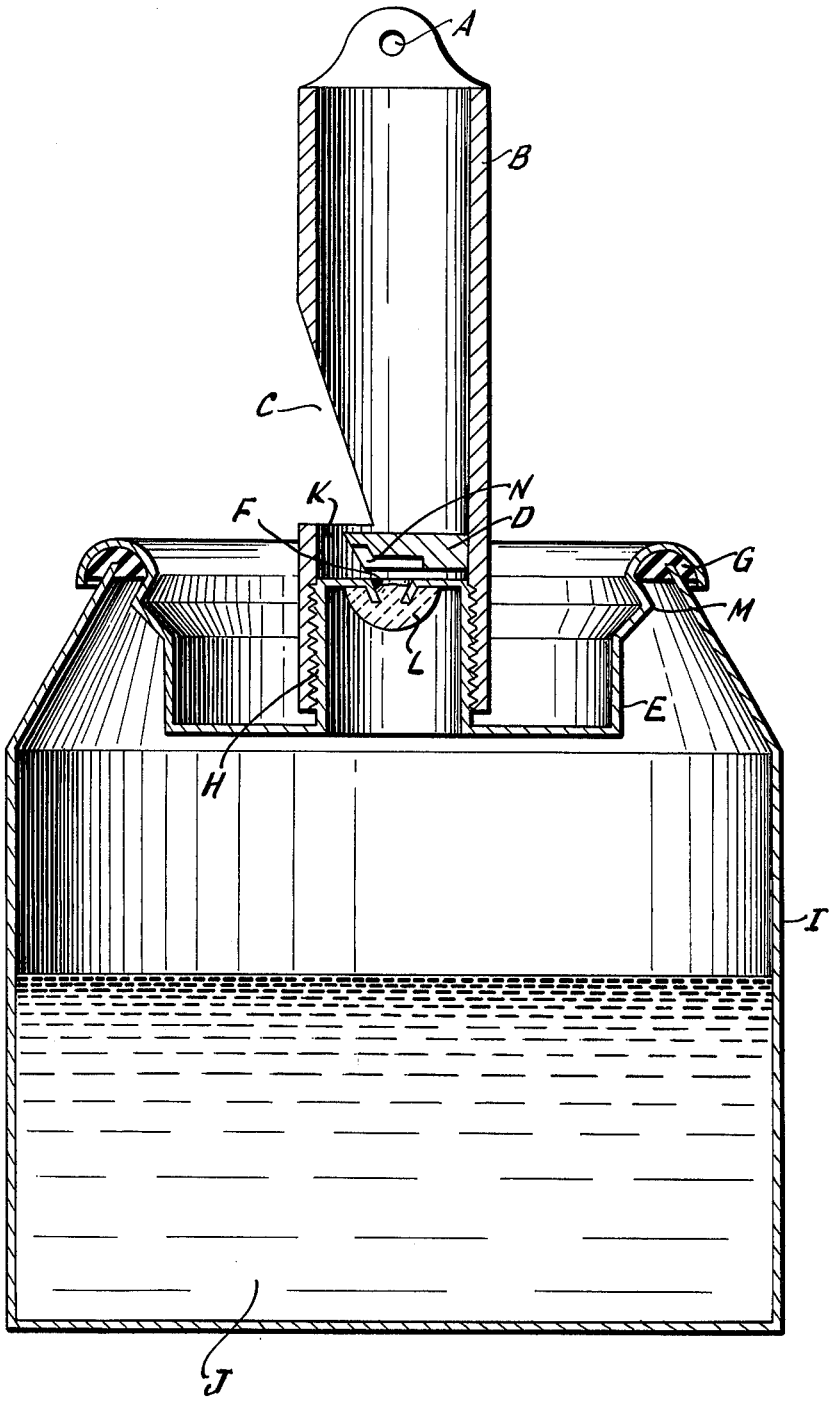
A
B
C
K
N
F
D
G
M
L
E
H
I
J

ALARM

BACKGROUND OF THE INVENTION

The invention relates to alarms and more particularly alarms that are customarily used to detect fires or excessive heat.

This invention is designed to perform the same safety function as any other alarm activated by heat or fire, be it powered by electric, mechanical, or other gaseous means.

The alarms presently available to protect against heat and fire and powered by batteries, or electricity and their complexity causes them to have a cost that may discourage their purchase and use. Such alarms also may fail to perform because of battery loss of power or lack of current in electrical units. It is also possible that the heat or fire may damage or interfere with the proper function of some electrical alarms.

The alarm of the present invention is self contained and requires no external power and is always operational.

It is the primary object of this invention to provide an alarm system that is selfcontained and is activated by heat or fire at a preset temperature.

Another object of this invention is to disclose a self-powered system that has a specific propellent that exits through an orifice that has been opened by heat or fire.

It is also an object of this invention to prescribe certain volumes of fill for certain containers particularly as it relates to the orifice opening in the valve mounting cup.

It will be shown how the proper combination and specifications can produce a unique alarm that will be extremely economical, and require no maintenance.

Although alarms to detect and warn of excessive heat or fire are not new it has been determined that a pressurized container having a fluorinated propellent, an opening sealed with a low melt solder composition, and a sounding alarm, can be an effective alarm system.

SUMMARY OF THE INVENTION

Briefly, the present invention may be described as a container with an alarm that is threaded so as to be screwed onto a threaded pedestal of a sealed pressurized container wherein an insert of the alarm has a directional channel on its side facing the hole in the mounting cup pedestal so as not only to direct the vapor stream out of the sounding opening unit but it also directs the melted solder out of the sounding opening so as not to interfere with the sound produced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS:

The single FIGURE of the drawing is a side elevation partially in section of a device according to the invention.

DETAILED DESCRIPTION OF THE PREFERRED EMBODIMENT:

To effect a properly functioning unit several factors relating to the construction of the invention must be detailed.

Experimental evidence has shown that to produce an effective pressurized alarm that emits sound when exposed to heat or fire it must be in a suitable container I that is constructed of metal, that could be either steel or aluminium, and of sufficient thickness to contain the pressure of the propellent J which in this invention is dichlorodifluoromethane and which has a pressure of 70 pounds per square inch gage at 70° F. The propellent J is sealed in the container I by mounting cup E which is crimped M to the container I with a rubber sealing gasket G.

The mounting cup E is a steel cup with a threaded pedestal H in the center. These threads H are to be used to screw the alarm B to the container I. The mounting cup E has at the top center of the pedestal an orifice or cup hole F that must be of specific size. The ideal opening is an 0.050 inch orifice and has an acceptable operating size of from 0.040 inch to 0.060 inch. If the size of orifice F becomes substantially smaller than 0.040 inch not enough propellent J will escape during its operation to sound the alarm, and if the size of orifice F becomes substantially larger than 0.060 inch the escaping propellent J may cause the container to be propelled like a rocket taking off.

The solder L has a particular melting point of 136° F. This solder L is used to seal the orifice F preventing the propellent J from escaping from the container I. The solder L maintains its seal until the heat melts it liberating the propellent J. The amount of solder L used is also quite critical. If the amount is to small it may be insufficient to properly seal the orifice F and if there is an excess it could cause the container I to explode or shoot off like a rocket. This is possible because the extra time needed to melt an excess of solder L allows the propellent J to be heated to a pressure beyond the limits of the container system. It has been determined that for an orifice F of 0.050 inch the amount of solder L needed is 0.70 gram. The ideal limits are 0.40 gram to 1.00 gram. It is possible that higher amounts of solder L could be used if a heavier constructed container I is used.

The alarm B that is attached to the mounting cup E is screwed onto the threads H on the pedestal. This alarm is to be of sufficient length; an inch or slightly longer has been demonstrated to be an effective alarm if combined with a diameter of approximately one quarter to one half inch. The opening in the alarm C should be approximately one quarter of an inch by one half of an inch. The alarm B is fitted with an insert D to produce an audible sound. The insert D should not have more than one quarter of the arc radius removed and fitted to face out the opening C of the alarm to produce the opening sound channel K. The underside of the insert D has a channel N that can direct not only the vapor stream out the opening K but is also used to channel out the solder L after it has melted away from the cup hole F. The alarm B and the insert D should be constructed of metal such as aluminium, steel, or zinc.

The container I is designed to be used in an upright position only. The alarm B has a mounting hole A so it may hung in an upright position or used to support the container I in an upright position. The alarm will only work in the upright position since vapor is necessary to sound the alarm B since inverted or horizontal positions will release only liquid propellent J.

The amount of propellent J in the container I should occupy about half the volume of the container I. The reason for allowing such a large amount of vapor space is to make sure that there is sufficient vapor available to sound the alarm B. Experimental evidence shows that not more than sixty percent of the volume of the container I should be filled with propellent J to produce a sustained audible sound.

While specific embodiments of the invention have been shown and described in detail to illustrate the application of the inventive principles, it will be understood that the invention may be embodied otherwise without departing from such principles.

What is claimed is:

1. A fire alarm assembly comprising a container defining an internal enclosed volume, means defining an orifice in flow communication with said internal volume of said container, said orifice being dimensioned with a size within the range between about 0.040 inches and 0.060 inches, a plug sealing said orifice thereby to seal said internal volume of said container to prevent escape therefrom of fluid, said plug consisting essentially of between about 0.40 and 1.0 grams of a material which will melt at a predetermined temperature to unseal said orifice and permit fluid flow therethrough out of said container, flange means located proximite said orifice and extending therefrom with a slanted configuration inwardly of said container, said flange means being embedded within said plug material to hold said plug in place in sealing engagement over said orifice on a side thereof inwardly of said container, a compressible liquified gas contained within said container in an amount such that the volume of the liquid phase of said gas does not exceed 60% of the total volume of said container, and sonic means in operative proximity to said orifice for producing an audible alarm signal due to fluid flow emitted from said container through said orifice upon melting of said plug material.

2. A fire alarm according to claim 1 wherein said compressible liquified gas contained within the said container is dichlorodifluoromethane, said gas being sealed in said container by a mounting cup having a threaded pedestal with said orifice being defined to extend through said pedestal as a pedestal hole.

3. A fire alarm according to claim 1 wherein said plug material is a low melt solder.

4. A fire alarm according to claim 1 wherein said orifice size is 0.050 inches.

5. A fire alarm according to claim 1 wherein said plug consists essentially of 0.70 grams of solder.

* * * * *